US010714070B1

(12) United States Patent
Su et al.

(10) Patent No.: US 10,714,070 B1
(45) Date of Patent: Jul. 14, 2020

(54) SOUND ISOLATION DEVICE

(71) Applicant: Toyota Motor Engineering & Manufacturing North America, Inc., Plano, TX (US)

(72) Inventors: Xiaoshi Su, Ann Arbor, MI (US); Debasish Banerjee, Ann Arbor, MI (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 0 days.

(21) Appl. No.: 16/669,852

(22) Filed: Oct. 31, 2019

Related U.S. Application Data

(63) Continuation of application No. 16/436,026, filed on Jun. 10, 2019.

(51) Int. Cl.
*G10K 11/172* (2006.01)
*G10K 11/20* (2006.01)
*G10K 11/162* (2006.01)

(52) U.S. Cl.
CPC ..... *G10K 11/172* (2013.01); *G10K 11/162* (2013.01); *G10K 11/20* (2013.01)

(58) Field of Classification Search
CPC ..... G10K 11/172; G10K 11/162; G10K 11/20
USPC ..... 181/286, 229
See application file for complete search history.

(56) References Cited

U.S. PATENT DOCUMENTS 3,887,031 A * 6/1975 Wirt ..... E04B 1/86 181/286
5,137,111 A 8/1992 Diduck et al.
5,491,310 A * 2/1996 Jen ..... E04B 1/86 181/286
7,451,855 B2 * 11/2008 Wang ..... E04B 1/8209 181/198
7,604,094 B2 * 10/2009 Magyari ..... G10K 11/20 181/286
7,819,224 B2 * 10/2010 Borchers ..... F01D 25/30 181/213
8,381,872 B2 * 2/2013 Alexander ..... E04B 1/8409 181/296
9,607,600 B2 * 3/2017 Swallowe ..... G10K 11/172
2017/0263235 A1 * 9/2017 Elford ..... G10K 11/172

FOREIGN PATENT DOCUMENTS

CN 106205590 A 12/2016

OTHER PUBLICATIONS

Lee et al., "Ultrasparse Acoustic Absorbers Enabling Fluid Flow and Visible-Light Controls," Physical Review Applied 11, 024022, pp. 1-13 (2019).

(Continued)

*Primary Examiner* — Forrest M Phillips
(74) *Attorney, Agent, or Firm* — Christopher G. Darrow; Darrow Mustafa PC

(57) ABSTRACT

A sound isolation device includes an acoustic scatterer that has an acoustic monopole response and an acoustic dipole response. The acoustic dipole response and the acoustic monopole response of the acoustic scatterer may have substantially similar resonant frequencies. The device may include a plurality of acoustic scatters forming an array of equally spaced apart acoustic scatterers.

17 Claims, 8 Drawing Sheets

(56) References Cited

OTHER PUBLICATIONS

Elliott et al., "Omnidirectional acoustic absorber with a porous core and a metamaterial matching layer," Journal of Applied Physics 115, 204902, pp. 1-13 (2014).
Liang & Li, "Extreme Acoustic Metamaterial by Coiling up Space," Physical Review Letters 108, 114301, pp. 1-4 (2012).
Cheng et al., "Ultra-sparse metasurface for high reflection of low-frequency sound based on artificial Mie resonances," Nature Materials, vol. 14, pp. 1013-1019 (2015).
Long et al., "Multiband quasi-perfect low-frequency sound absorber based on double-channel Mie resonator," Applied Physics Letters 112, 033507, pp. 1-5 (2018).
Ghaffarivardavagh et al., "Ultra-open acoustic metamaterial silencer based on Fano-like interference," Phys. Rev. B 99, 024302, Abstract, 3 pages (2019).

* cited by examiner

SOUND ISOLATION DEVICE

CROSS-REFERENCE TO RELATED APPLICATION

This application is a continuation of U.S. patent application Ser. No. 16/436,026, entitled "Sound Isolation Device," filed Jun. 10, 2019, which is incorporated by reference herein in its entirety.

TECHNICAL FIELD

The present disclosure generally relates to sound isolation systems and devices and, more particularly, to sound isolation systems and devices that include an acoustic scatterer that has an acoustic monopole response and an acoustic dipole response.

BACKGROUND

The background description provided is to generally present the context of the disclosure. Work of the inventors, to the extent it may be described in this background section, and aspects of the description that may not otherwise qualify as prior art at the time of filing, are neither expressly nor impliedly admitted as prior art against the present technology.

In some automotive applications, low-frequency noise has been a long-standing issue for passenger comfort. Vehicles can generate significant low-frequency noises. These low-frequency noises may emanate from a variety of sources, such as the powertrain and tires of the vehicle, wind noise, and the like.

There are several different solutions for managing low-frequency noises, but many have drawbacks. For example, one solution requires the use of high reflection material. Structures made of high reflection material, such as doors and windows, can reflect noises away from the cabin of the vehicle. However, the reflected noises may cause noise pollution, and the performance of these types of systems is limited by the mass law.

Another solution requires the use of high absorption material. However, conventional porous sound absorbing materials are only efficient for high frequency (greater than 1 kHz) noise reduction due to its high impedance nature. The sound transmission through porous materials is high if the material microstructure has a large porosity.

SUMMARY

This section generally summarizes the disclosure and is not a comprehensive disclosure of its full scope or all its features.

Examples of sound isolation devices and sound isolation systems are described herein. In one example, a sound isolation device includes an acoustic scatterer that has an acoustic monopole response and an acoustic dipole response. The acoustic dipole response and the acoustic monopole response of the acoustic scatterer may have substantially similar resonant frequencies. The device may include a plurality of acoustic scatters forming an array of equally spaced apart acoustic scatterers.

The acoustic scatterer may further include a first resonant chamber and a second resonant chamber. A first channel extends to the first resonant chamber, while a second channel extends to the second resonant chamber. The first resonant chamber and the second resonant chamber have substantially equal volumes.

In another example, a sound isolation system may include at least one acoustic scatterer for isolation. The at least one acoustic scatterer of the sound isolations system has an acoustic monopole response and an acoustic dipole response that have substantially similar resonant frequencies.

The system may also include a first wall and a second wall that generally oppose one another and define a space. The at least one acoustic scatterer is located in the space between the first wall and the second wall. Depending on the distance between the first wall and the second wall, multiple acoustic scatterers forming an array may be utilized to properly absorb the sound.

Further areas of applicability and various methods of enhancing the disclosed technology will become apparent from the description provided. The description and specific examples in this summary are intended for illustration only and are not intended to limit the scope of the present disclosure.

BRIEF DESCRIPTION OF THE DRAWINGS

The present teachings will become more fully understood from the detailed description and the accompanying drawings, wherein.

The figures set forth herein are intended to exemplify the general characteristics of the methods, algorithms, and devices among those of the present technology, for the purpose of the description of certain aspects. These figures may not precisely reflect the characteristics of any given aspect and are not necessarily intended to define or limit specific embodiments within the scope of this technology. Further, certain aspects may incorporate features from a combination of figures.

DETAILED DESCRIPTION

The present teachings provide sound absorbing structures having high acoustic absorbance despite being thin. The sound absorbing structures of the present teachings and in contrast to competing structures can provide high absorbance across a broad frequency range by combing multiple designs for different frequencies.

A sound isolation device includes an acoustic scatterer that has an acoustic monopole response and an acoustic dipole response. The acoustic dipole response and the acoustic monopole response of the acoustic scatterer may have substantially similar resonant frequencies. The device may include a plurality of acoustic scatters forming an array of equally spaced apart acoustic scatterers. By so doing, the array of acoustic scatterers can fully absorb sound waves at certain frequencies and hence provide extraordinary sound isolation performance.

With regards to the physics of the devices and system described in this specification, for acoustically small objects, the background and scattered waves can be decomposed into monopole and dipole components. Materials displaying a monopole response can only absorb the monopole component of the incident wave. The same limitation applies to dipole, as well. The acoustic scatterers described in this specification have a monopole and dipole scattering at a similar frequency. This is possible when the monopole and dipole modes degenerate. The benefit of have both monopole and dipole responses are that these two components of the incident wave will participate the momentum exchange process and hence become available for absorption.

More simply, the scattering strength of the monopole and dipole are the same so that their magnitudes are the same. The monopole and dipole scattering have constructive interference in the forward scattering direction and cancels the background wave so that the transmission is zero; then, of course, the monopole and dipole scattering have destructive interference in the backward scattering direction.

Figure 1:
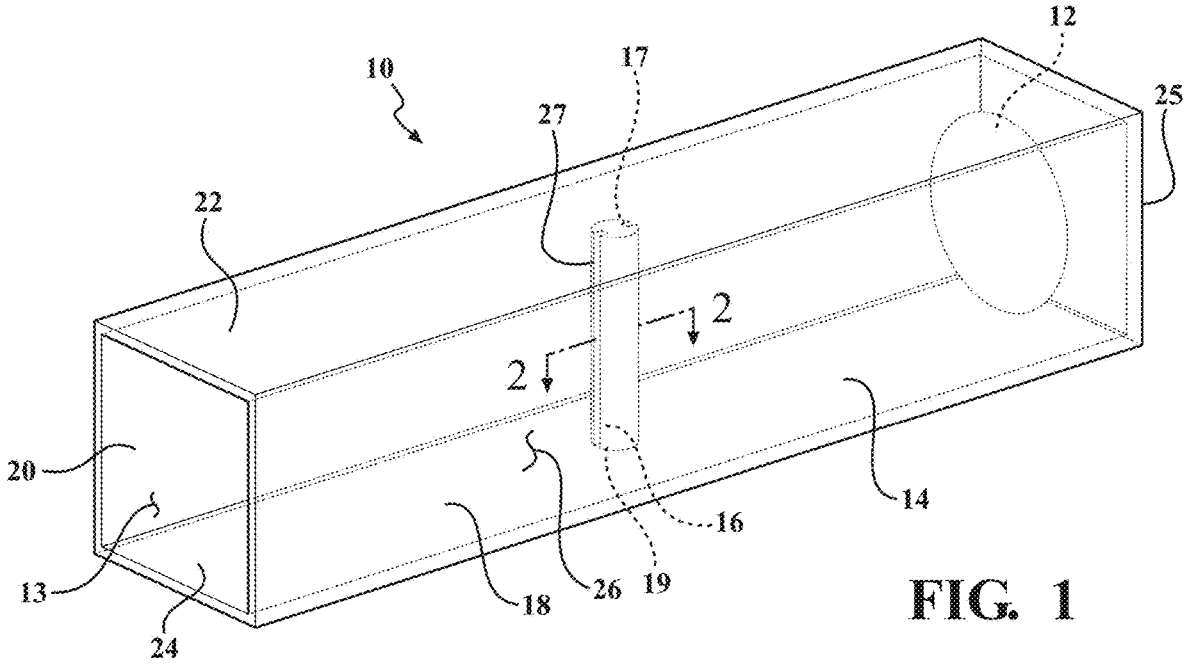
FIG. 1 illustrates a system for isolating sound utilizing an acoustic scatterer.
Figure 2A:
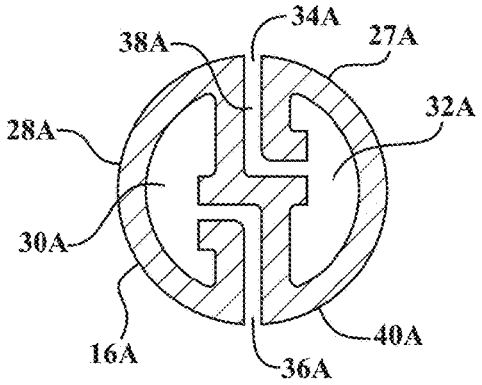
FIGS. 2A-2D illustrate different examples of the acoustic scatterer.
Figure 2B:
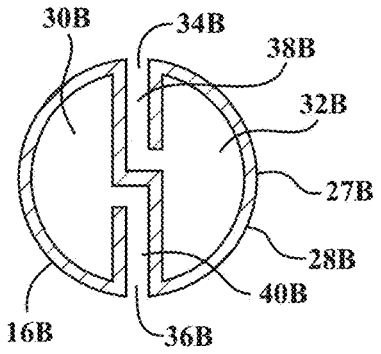
Figure 2C:
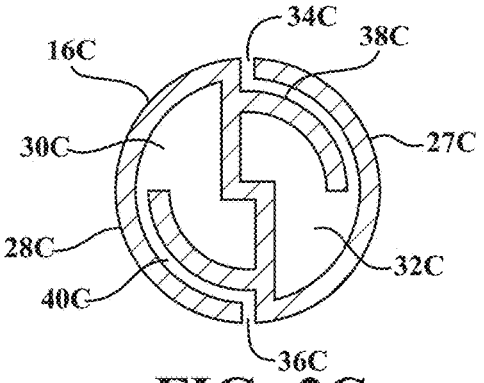
Figure 2D:
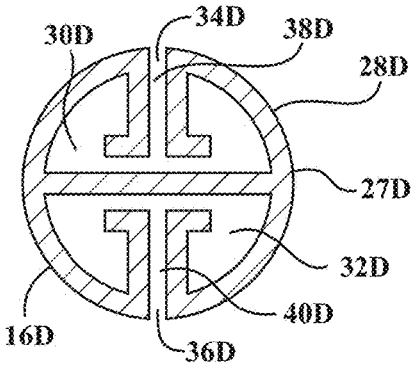

Referring to FIG. 1, one example of a sound isolation device 10 is shown. As its primary components, the sound isolation device 10 may include an acoustical source 12, a structure 14, and an acoustic scatterer 16. Regarding the acoustical source 12, the acoustical source 12 in this example is shown to be a speaker capable of producing sounds at a variety of wavelengths. However, it should be understood that the device 10 may be utilized in situations wherein sound is produced by the movement of one or more components. For example, the operation of components of an automobile, such as the rotating of the tires, wind noise, powertrain-related noises, and the like. As such, the source of the sound is not necessarily a speaker 12.

The structure 14, in this example, is shown to include a plurality of walls 18, 20, 22, and 24. The walls 18 and 20 generally oppose one another, while the walls 22 and 24 generally oppose one another. The walls 18, 20, 22, and 24 define a space 26 within the structure 14 and an opening 13, located opposite of the acoustical source 12. The structure 14 can be utilized in any one of several different applications. For example, the structure 14 could be mounted within a vehicle or forms a structural member or an additional part of the vehicle.

Within the space 26 defined by the walls 18, 20, 22, and 24 of the structure 14 is the acoustic scatterer 16. The acoustic scatterer 16 may have an acoustic monopole response and an acoustic dipole response. An acoustic monopole radiates sound waves towards all direction. The radiation pattern of monopole generally has no angle dependence for both magnitude and phase of the sound pressure. The radiation of acoustic dipole has an angle dependence $e^{i\theta}$, where $\theta$ is the polar angle in 2D. The pressure fields have the same magnitude and the opposite phase at the same distance along the two opposite radiation directions. The monopole response is equivalent to the sound radiated from a pulsating cylinder whose radius expands and contracts sinusoidally. The dipole response is equivalent to the sound radiated from two pulsating cylinders separated from each other with a small distance, the two pulsating cylinders radiate sound with the same strength but opposite phase.

The acoustic dipole response and the acoustic monopole response of the acoustic scatterer 16 may have substantially similar resonant frequencies. The term "substantially similar" regarding resonant frequencies should be understood to mean that the resonant frequencies may differ by approximately 10% or less. The acoustic scatterer 16 generally has a housing 27 that defines the overall shape of the acoustic scatterer 16. Generally, the housing 27 may be symmetrical across the width of the housing 27. However, the housing 27 may take any one of several different shapes. There may be end caps 17 and 19 located at opposite ends of the housing 27.

Referring to FIG. 2A-2D, a cross-section, generally along lines 2-2 of FIG. 1, of different examples of acoustic scatterers 16A-16D are shown. It should be understood that the different designs of the acoustic scatterers 16A-16D shown in FIGS. 2A-2D are merely examples. The acoustic scatterer 16 could take any one of several different designs, not just those shown and described in this disclosure. Each of the acoustic scatterers 16A-16D may have housings 27A-27D that are generally symmetrical in shape across the length of the housings 27A-27D. Each housing 27A-27D generally define a perimeter 28A-28D.

The acoustic scatterers 16A-16D each have first resonant chambers 30A-30D and second resonant chamber 32A-32D, respectively. The first resonant chambers 30A-30D individually have a substantially similar volume to their corresponding second resonant chambers 32A-32D, respectively. The term "substantially similar" regarding volumes should be understood to mean that the volumes may differ by approximately 10% or less.

In addition, the first resonant chambers 30A-30D and the second resonant chambers 32A-32D may be mirror images of each other across at least one line of symmetry and/or may have the same shape when viewing a cross-section of the acoustic scatterers 16A-16D. The first resonant chambers 30A-30D and second resonant chambers 32A-32D generally extend along the length of their respective housings 27A-27B and may terminate with an end cap, best shown in FIG. 1 as end caps 17 or 19.

The acoustic scatterers 16A-16D may each have first channels 38A-38D disposed within the housings 17A-17D, respectively. The first channels 38A-38D may extend from the first resonant chambers 30A-30D to openings 34A-34D formed within the perimeters 28A-28D of the housings 17A-17D, respectively. Additionally, the acoustic scatterers 16A-16D may each have second channels 40A-40D disposed within the housings 17A-17D, respectively. The second channels 40A-40D may extend from the second resonant chambers 32A-32D to openings 36A-36D formed within the perimeters 28A-28D of the housings 17A-17D, respectively. The first channels 38A-38D may be separate from the second channels 40A-40D, respectively.

The first channels 38A-38D and second channels 40A-40D may be mirror images of each other across at least one line of symmetry or may have the same general shape when viewing a cross-section of the acoustic scatterers 16A-16D. The first channels 38A-38D and second channels 40A-40D generally extend along the length of their respective housings 27A-27B and may terminate with an end cap, as best shown in FIG. 1 as end caps 17 or 19.

The acoustic scatterers 16A-16D may be made using any one of several different materials. For example, the acoustic scatterers 16A-16D may be made from an acoustically hard material, such as plastic, silicon, glass, and/or metals. As to metals, any metal may be utilized, such as aluminum, steel, titanium, etc.

Figure 3A:
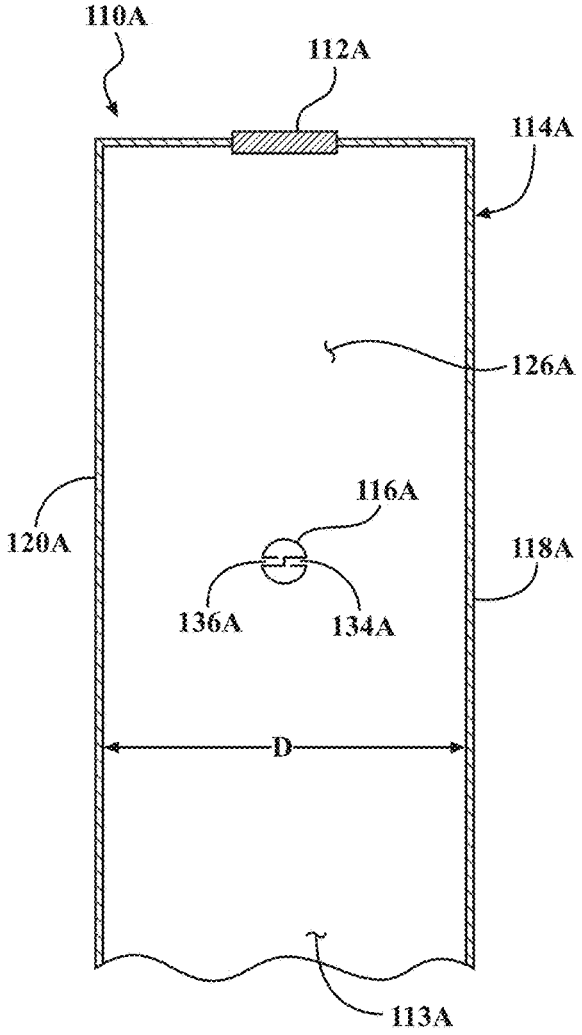
FIGS. 3A and 3B illustrate different implementations of the acoustic scatterer.
Figure 3B:
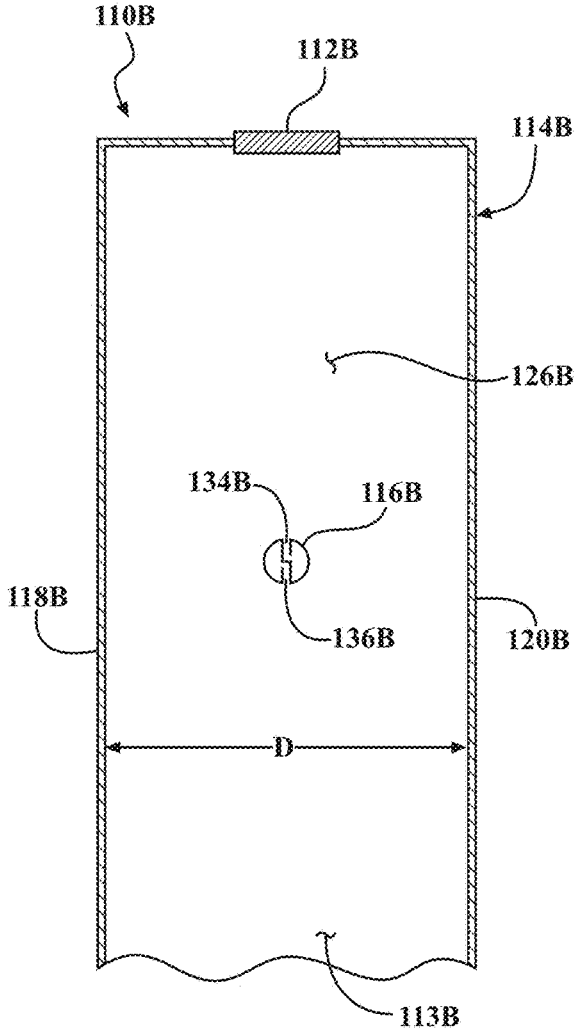

Referring to FIGS. 3A and 3B, two other examples of the sound isolating device 110A and 110B are shown, respectively. Here, like reference numerals have been utilized to refer to like elements, with the exception that the reference numerals have been incremented by 100. Additionally, it is noted that the acoustic scatterer 116A and 116B are in the shape of the acoustic scatterer 16B illustrated in FIG. 2B. However, it should be understood that any of the different types of acoustic scatterers described in this description or otherwise conceivable could be utilized.

Regarding FIG. 3A, the device 110A includes an acoustic scatterer 116A. The device 110A also includes walls 118A and 120A that are separated from each other by the distance D. The walls 118A and 120A generally oppose one another and define a space 126A therebetween. The device 110A also includes a sound source 112A, which could be a speaker or any other source of sound, such as sounds produced by a nearby component, such as a vehicle powertrain, noise from wind coming in to contact with the vehicle, and/or tire noise emanating from the tires of the vehicle.

At the opposite end of the sound source 112A is an opening 113A. The acoustic scatterer 116A may be located near a midway point between the walls 118A and 120A. This midway point is essentially half the distance D between the walls 118A and 120A. Here, the acoustic scatterer 116A is arranged so the openings 134A and 136A generally face the walls 118A and 120A, respectively. As explained in greater detail later in this specification, the arrangement of the acoustic scatterer 116A so the openings 134A and 136A generally face the walls 118A and 120A, may result in an absorption coefficient of 0.5. In situations where the openings 134A or 136A faces the sound source 112A, the absorption coefficient may be approximately 1.0. As such, the sound absorption characteristics of the acoustic scatterer 116A may be adjusted by simply rotating the acoustic scatterer 116A.

The distance D between the first wall 118A and the second wall 120A can vary based on the type of wavelength that one wishes to reduce. The distance D should be smaller than the wavelength at the resonant frequency:

$$D < \frac{c}{f},$$

wherein D is the distance of the space between the first wall 118A and the second wall 120A, c is a speed of sound, and f is the resonant frequency of the monopole response and the dipole response of the acoustic scatterer 116A.

The distance D between the first wall 118A and the second wall 120A is tunable even for one frequency. The distance D can be tuned by redesigning the acoustic scatterer 116A to change the strength of the scattered monopole and dipole moments.

Turning attention to FIG. 3B, the device 110B is shown and is similar to the device 110A illustrated in FIG. 3A. The difference in this example is that the acoustic scatterer 116B of the device 110B has been rotated so the opening 134B of the acoustic scatterer 116B substantially faces the sound source 112B. It has been observed that the monopole and dipole responses of the acoustic scatterer 116B of the present application are direction-dependent. For example, the absorption coefficient of the acoustic scatterer 116B can be as high as total absorption 1.0 and can be adjusted to 0.5 by rotating the acoustic scatterer 116B 90°.

In FIG. 3B, when the acoustic scatterer 116B is rotated so the opening 134B or the opening 136B faces the sound source 112B, the coefficient of absorption will be greater than the configuration shown in FIG. 3A, wherein the acoustic scatterer 116A has been rotated so the openings 134A and 136A generally face the walls 118A and 120A, respectively. In one example, the absorption coefficient of the acoustic scatterer 116B of FIG. 3B may be about 1.0, while the the acoustic scatterer 116B of FIG. 3B may be about 0.5. However, it should be understood that these absorption coefficients may vary.

Figure 6:
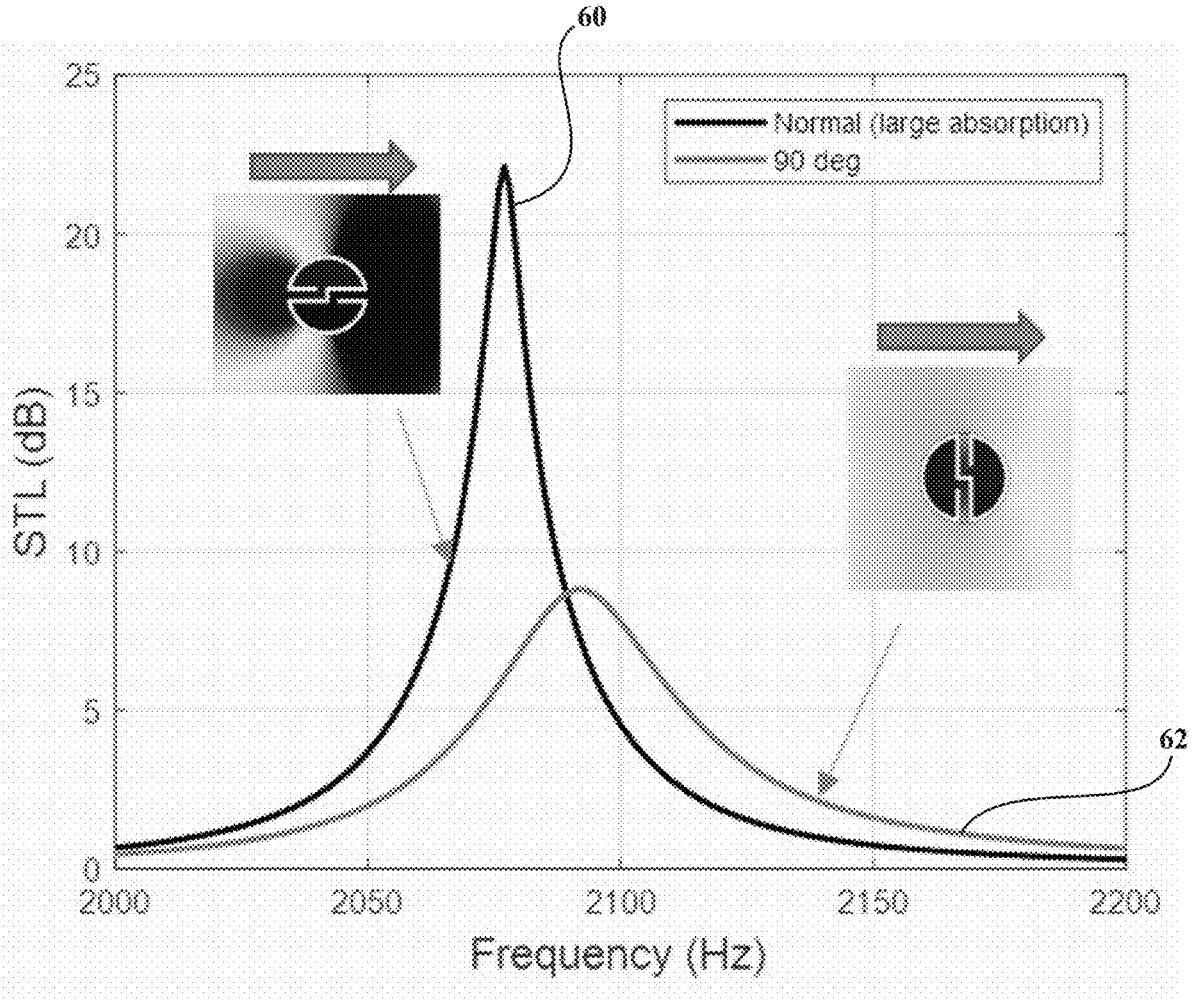
FIG. 6 illustrates the absorption capabilities of an acoustic scatterer when placed in a normal orientation and rotated 90° from the normal orientation.

Further details regarding the effect of rotating the acoustic scatterer are illustrated in FIG. 6. FIG. 6 illustrates the sound transmission loss (STL) of a sound having a frequency between 2000 Hz and 2200 Hz. Line 60 represents the STL characteristics of the device 110B of FIG. 3B, wherein the opening 134B or 136B of the acoustic scatterer 116B generally faces the sound source 112B. Line 62 represents the STL characteristics of the device 110A of FIG. 3A, wherein the opening 134B faces the wall 118A and the opening 136A faces the wall 120A. The absorption characteristic is approximately 0.5.

Figure 4A:
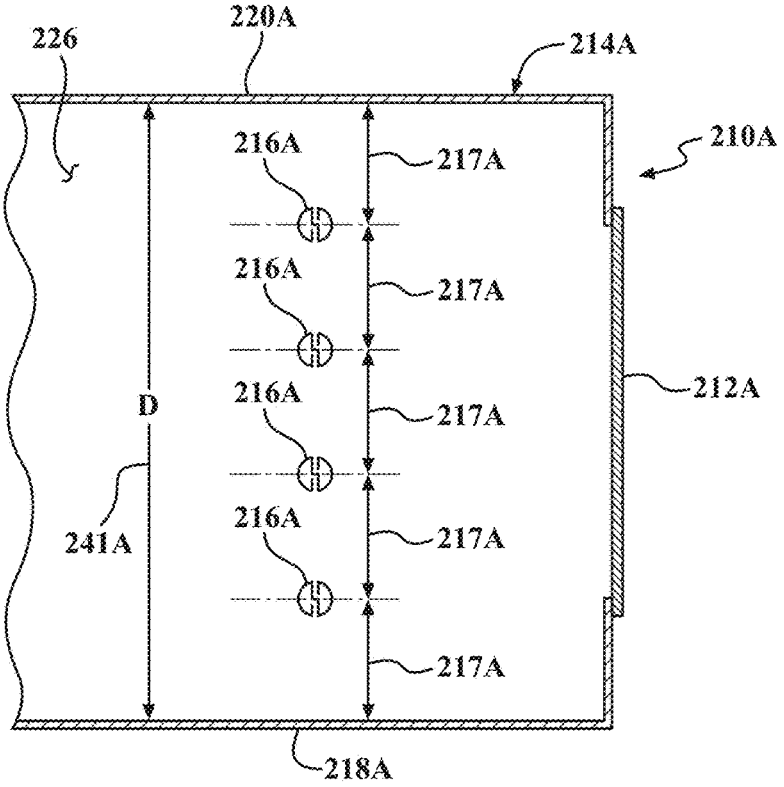
FIGS. 4A-4D illustrate different implementations of a plurality of acoustic scatterers forming an array.

Referring to FIG. 4A, an example of a system 210A is shown Like before, like reference numerals have been utilized to refer to like elements. In this example, there are four acoustic scatterers 216A that form an array. The array of acoustic scatterers 216A generally forms a row that is perpendicular to the walls 218A and/or 220A. This type of configuration can be useful in situations wherein the distance D between the walls is fairly wide and requires a plurality of acoustic scatterers 216A to provide appropriate sound absorption type characteristics to the system 210A.

The distances 217A between each of the acoustic scatterers 216A and/or the acoustic scatterers 216A at the end of the row and the wall 218A or 220A are substantially equal. Regarding "substantially equal", this means that the distances 217A may vary by as much as 10%. The total number of acoustic scatterers 116A for the array to optimally absorb sound is generally based on the distance 241A between the first wall 218A and the second wall 220A. The total number (N) of acoustic scatterers required for an application can be expressed as follows:

$$N=D/(c/f),$$

wherein D is a distance between the first wall 218A and the second wall 220A, c is the speed of sound in air, and f is the resonant frequency of the monopole response and the dipole response.

Figure 4B:
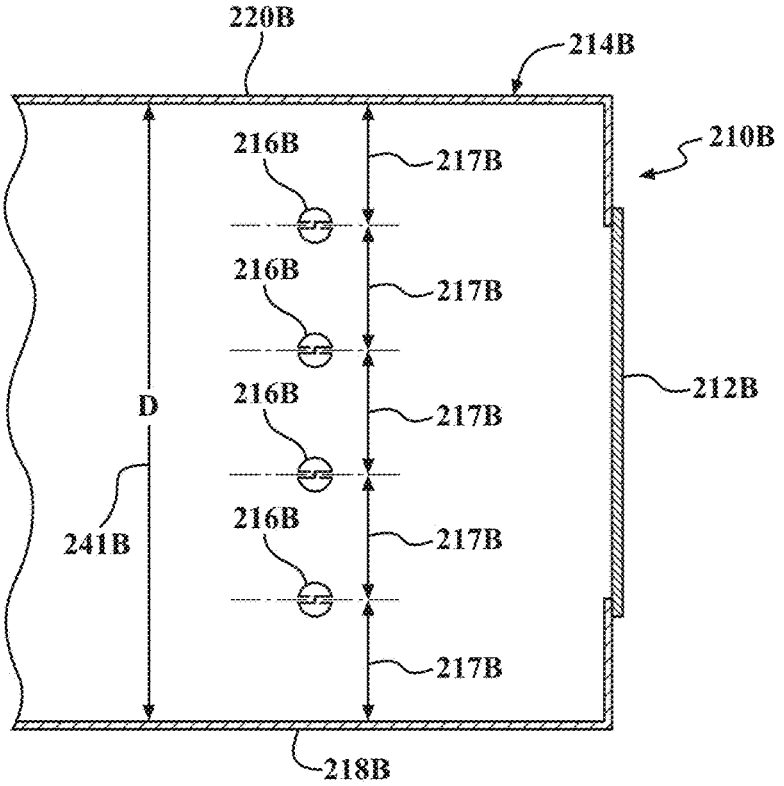

Referring to FIG. 4B, this figure illustrates a similar set up to FIG. 4A, but this set up differs in that the acoustic scatterers 216B have been rotated 90° so the openings of the acoustic scatterers 216B substantially face the sound source 212B. This type of configuration would essentially yield a greater sound absorption coefficient than the arrangement shown in FIG. 4A.

Figure 4C:
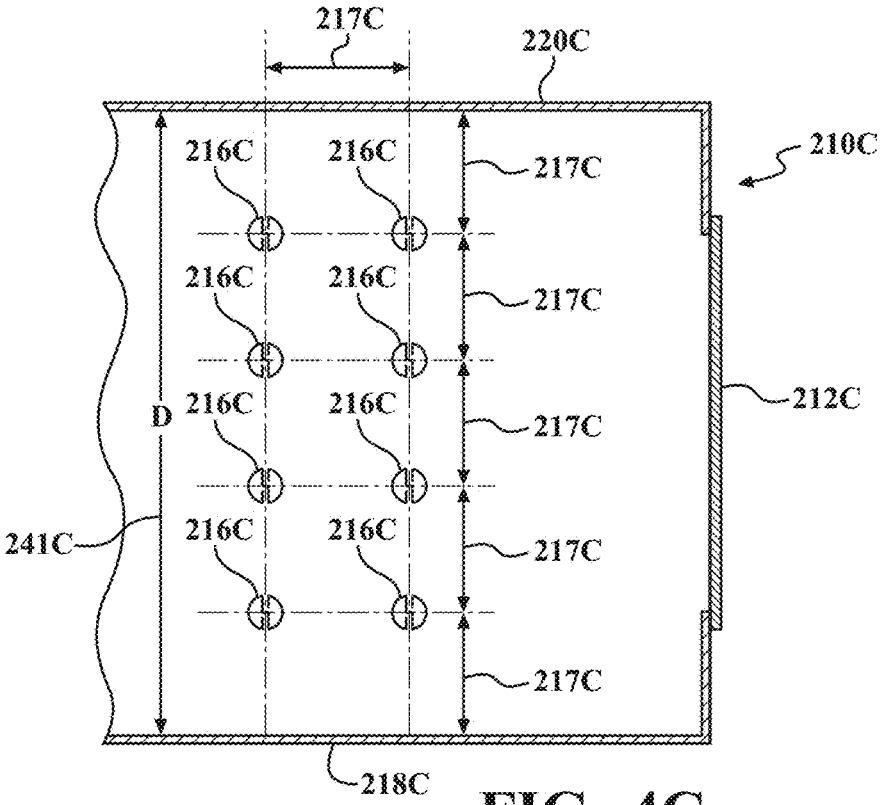

Referring to FIG. 4C, this example of the system 210C is similar to the system illustrated in FIG. 4A. However, the system 210C has two rows of acoustic scatterers 216C. Like before, the distances 217C between the acoustic scatterers 216C across the width (between the walls 218C and 220C) of the system 210 C is substantially equal. In addition, the distance between the acoustic scatterers 216C from one row to another is also substantially similar to the distance 217C. The purpose of having two (or more) rows of acoustic scatterers 216C is to improve the overall sound absorption characteristics of the system 210C. While only one row may be necessary, a second row will provide additional absorption of sound.

Figure 4D:
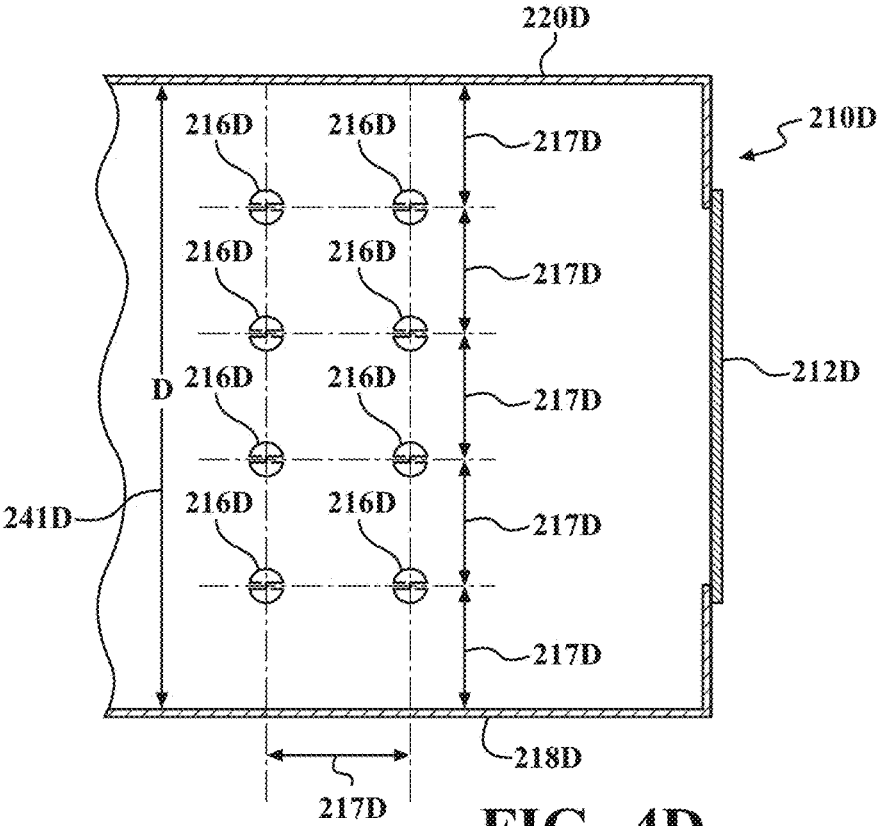

The system 210D of FIG. 4D is similar to the system 210C of FIG. 4C, with the exception that the acoustic scatterers 216D of FIG. 4D have been rotated 90° as compared to the acoustic scatterers 216C of FIG. 4C. This type of configuration would essentially yield a greater sound absorption coefficient than the arrangement shown in FIG. 4C.

Figure 5:
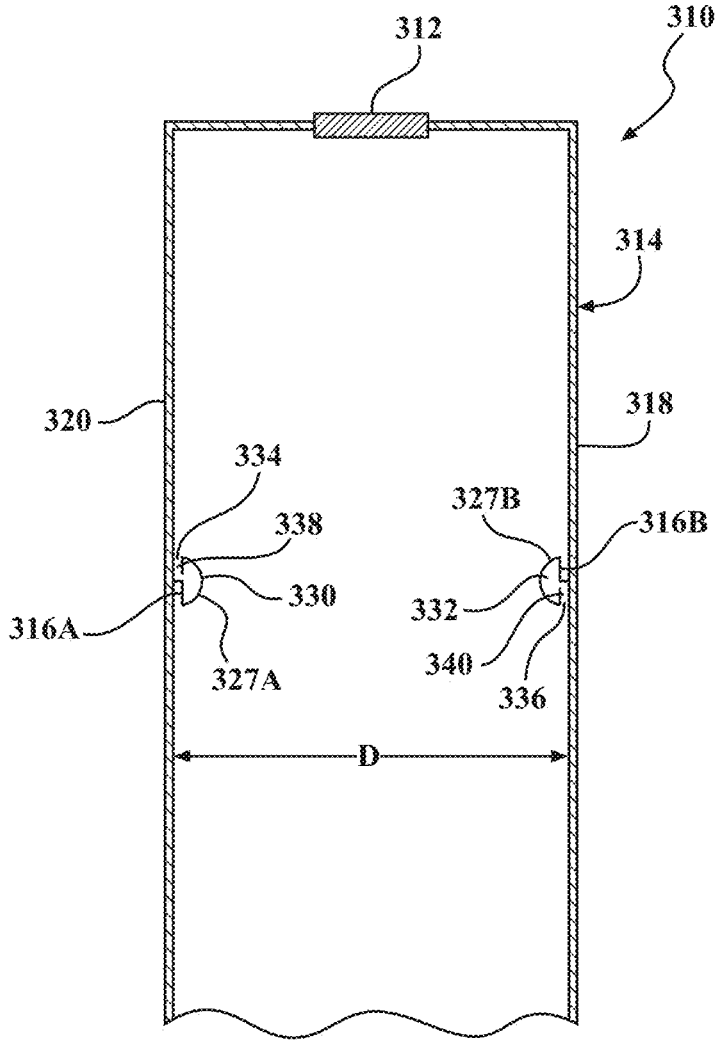
FIG. 5 illustrates an implementation of an acoustic scatterer being adjacent to opposite sides of opposing walls.

Referring to FIG. 5, a device 310 is shown. In this example, the acoustic scatterer 316A and 316B are housed in two separate housings 327A and 327B. The acoustic scatterer 316A includes a resonant chamber 330 and a channel 338 that leads to the resonant chamber 330 from an opening 334. The scatterer 316B also includes a resonant chamber 332 and a channel 340 that leads from the resonant chamber 332 to an opening 336. The housings 327A and 327B generally face each other and are adjacent to walls 320 and 318, respectively.

Figure 7A:
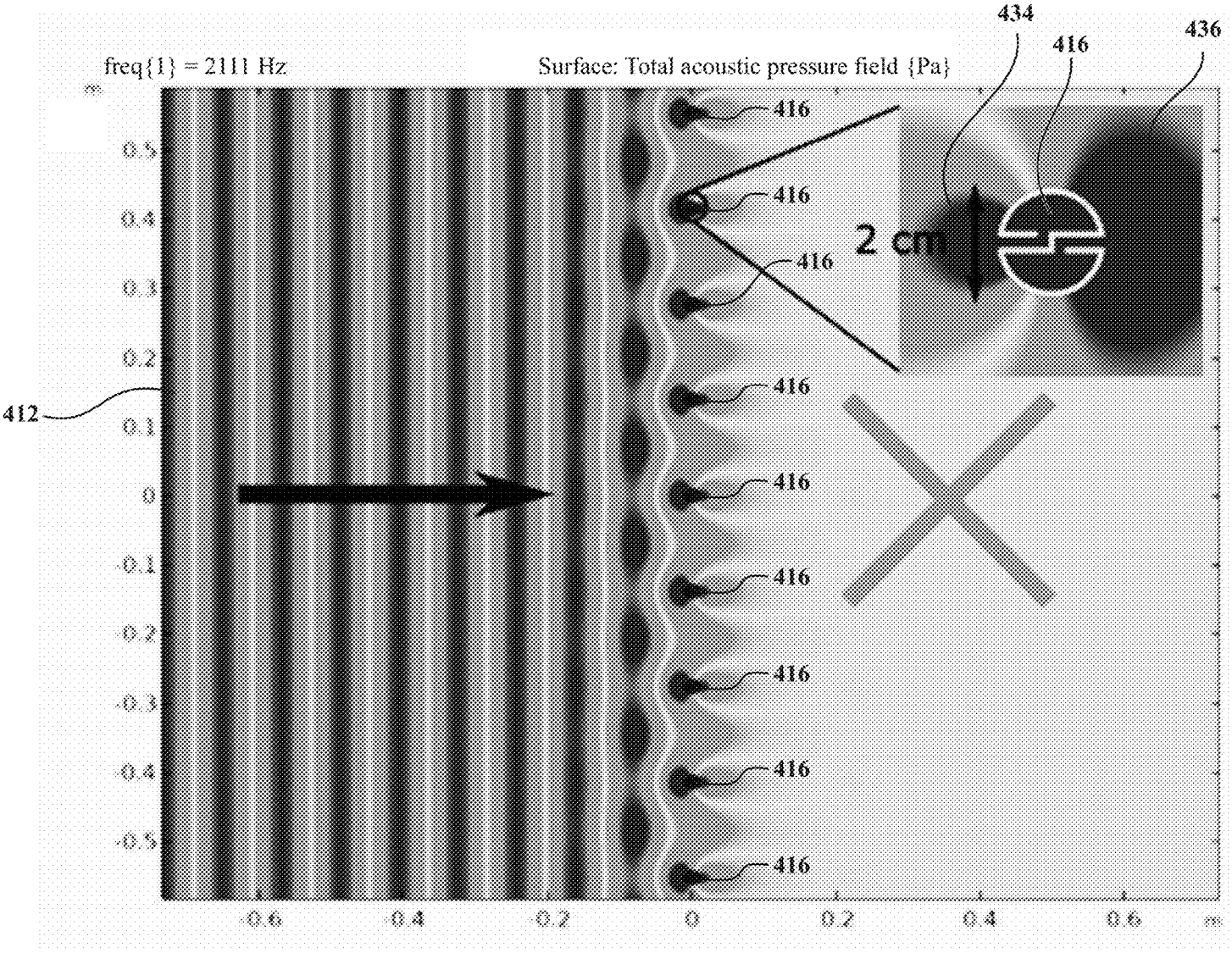
FIGS. 7A-7C illustrate the results of the absorption capabilities of an array of acoustic scatterers.

The distance D between the first wall 318 and the second wall 320 can vary based on the type of wavelength that one wishes to reduce. The distance D should be smaller than the wavelength at the resonant frequency:

$$D < \frac{c}{f},$$

wherein D is the distance of the space between the first wall 318 and the second wall 320, c is a speed of sound, and f is the resonant frequency of the monopole response and the dipole response of the acoustic scatterer 316A and 316B Referring to FIG. 7A, a simulation of a system having nine separate acoustic scatterers 416 forming an array having one row is shown. Here, the acoustic scatterers 416 are rotated so the openings 434 of the acoustic scatterers 416 substantially face the source of sound 412. FIG. 7A illustrates a total sound field having a frequency of 2111 Hz. One can see in this figure that the amplitude of the wave at the left side of the array of the acoustic scatterers 416 is unitary meaning there is no reflection. Also, the amplitude of the wave at the right side of the array of the acoustic scatterers 416 is zero indicating that the transmission is zero—indicating total absorption.

Therefore, all the energy is absorbed by the array of the acoustic scatterers 416. In the magnified view of the single scatterer, one can see that the pressure field near the two split-ring acoustic scatterers 416 are of the opposite phase, but the shape is different. This is due to the superposition of the monopole and dipole moments. This design takes advantage of the two components and makes them scatter the same amount of energy to achieve total absorption.

Figure 7B:
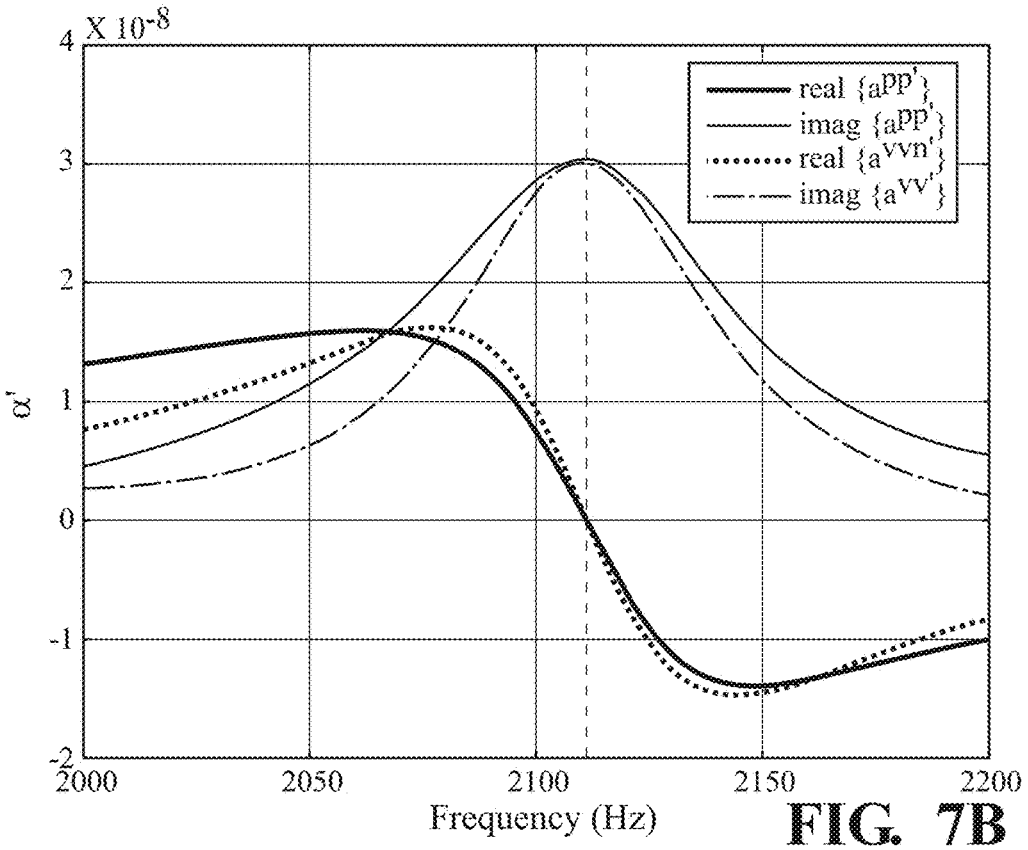
Figure 7C:
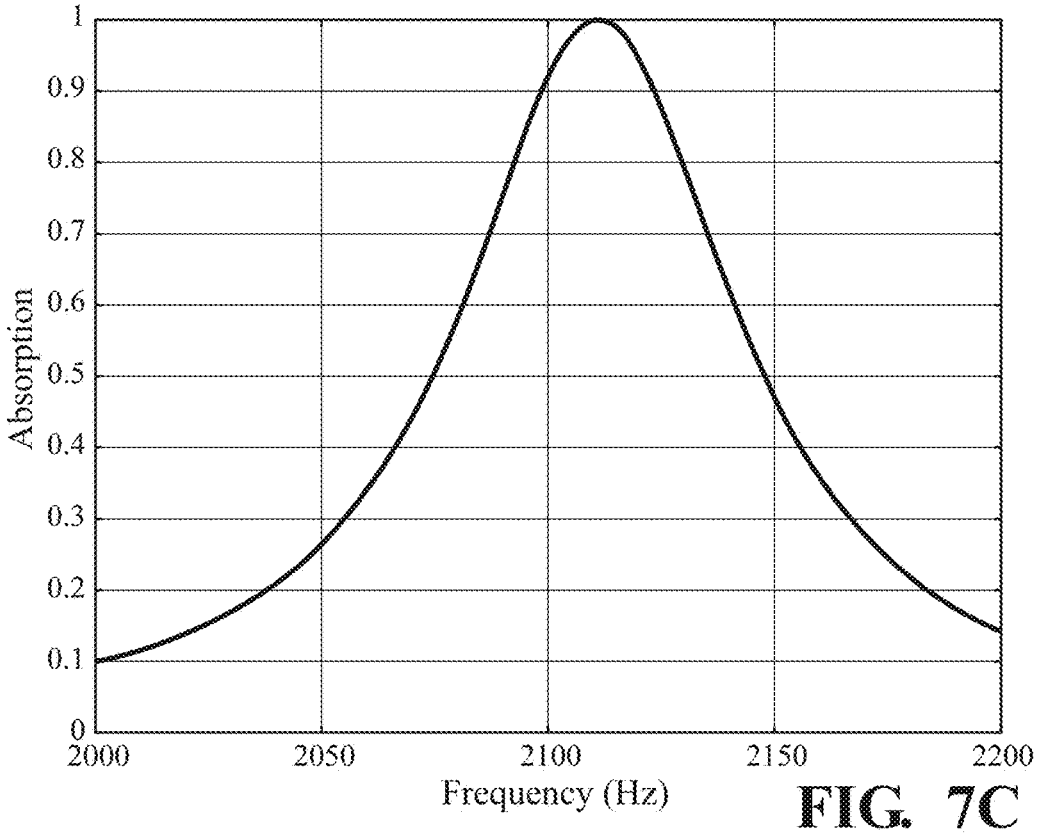

FIG. 7B illustrates monopole and dipole scattering coefficients. The two components have the same strength as required by the design. As shown in FIG. 7C, the absorption coefficient is 1.0 at 2111 Hz.

The preceding description is merely illustrative in nature and is in no way intended to limit the disclosure, its application, or uses. As used herein, the phrase at least one of A, B, and C should be construed to mean a logical (A or B or C), using a non-exclusive logical "or." It should be understood that the various steps within a method may be executed in different order without altering the principles of the present disclosure. Disclosure of ranges includes disclosure of all ranges and subdivided ranges within the entire range.

The headings (such as "Background" and "Summary") and sub-headings used herein are intended only for general organization of topics within the present disclosure and are not intended to limit the disclosure of the technology or any aspect thereof. The recitation of multiple embodiments having stated features is not intended to exclude other embodiments having additional features, or other embodiments incorporating different combinations of the stated features.

As used herein, the terms "comprise" and "include" and their variants are intended to be non-limiting, such that recitation of items in succession or a list is not to the exclusion of other like items that may also be useful in the devices and methods of this technology. Similarly, the terms "can" and "may" and their variants are intended to be non-limiting, such that recitation that an embodiment can or may comprise certain elements or features does not exclude other embodiments of the present technology that do not contain those elements or features.

The broad teachings of the present disclosure can be implemented in a variety of forms. Therefore, while this disclosure includes particular examples, the true scope of the disclosure should not be so limited since other modifications will become apparent to the skilled practitioner upon a study of the specification and the following claims. Reference herein to one aspect, or various aspects means that a particular feature, structure, or characteristic described in connection with an embodiment or particular system is included in at least one embodiment or aspect. The appearances of the phrase "in one aspect" (or variations thereof) are not necessarily referring to the same aspect or embodiment. It should be also understood that the various method steps discussed herein do not have to be carried out in the same order as depicted, and not each method step is required in each aspect or embodiment.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations should not be regarded as a departure from the disclosure, and all such modifications are intended to be included within the scope of the disclosure.

What is claimed is:

1. A sound isolation device comprising at least one acoustic scatterer, wherein the at least one acoustic scatterer includes:

an acoustic monopole response and an acoustic dipole response, wherein the acoustic dipole response and the acoustic monopole response of the acoustic scatterer have substantially similar resonant frequencies;

a first resonant chamber defined by a housing;

a first channel extending from a first opening defined within the housing to the first resonant chamber;

a second resonant chamber defined by the housing;

a second channel extending from a second opening defined within the housing to the second resonant chamber; and wherein the first opening is substantially diametrically opposed to the second opening.

2. The sound isolation device of claim 1, wherein the at least one acoustic scatterer includes a plurality of acoustic scatterers, wherein the plurality of acoustic scatterers are substantially equally spaced, and wherein the acoustic dipole response and the acoustic monopole response of the plurality of acoustic scatterers have substantially similar resonant frequencies.

3. The sound isolation device of claim 1, wherein the first resonant chamber and the second resonant chamber have substantially equal volumes.

4. The sound isolation device of claim 3, wherein:

the first resonant chamber and the second resonant chamber are separate from one another; and the first channel and the second channel are separate from one another.

5. The sound isolation device of claim 1, wherein at least one of the first channel, second channel, first chamber and second chamber have a uniform shape along a length of the housing.

6. The sound isolation device of claim 1, wherein the first resonant chamber and the second resonant chamber are symmetrical to one another.

7. The sound isolation device of claim 1, wherein the first channel and the second channel are symmetrical to one another.

8. The sound isolation device of claim 1, wherein the at least one acoustic scatterer has an adjustable absorption coefficient ranging from 0.5 to 1.0.

9. The sound isolation device of claim 8, wherein the adjustable absorption coefficient is adjusted by rotating the housing of the at least one acoustic scatterer with respect to a sound source.

10. The sound isolation device of claim 1, wherein the at least one acoustic scatterer is mounted within a vehicle.

11. The sound isolation device of claim 10, wherein the acoustic scatterer forms a structural member of the vehicle.

12. A sound isolation system comprising:

at least one acoustic scatterer for sound isolation, wherein the at least one acoustic scatterer comprises:

an acoustic monopole response and an acoustic dipole response, wherein the acoustic dipole response and the acoustic monopole response of the acoustic scatterer have substantially similar resonant frequencies, a first resonant chamber, a first channel extending to the first resonant chamber, a second resonant chamber, and a second channel extending to the second resonant chamber; and a first wall and a second wall, wherein the first wall and second wall generally oppose one another and define a space, wherein the at least one acoustic scatterer is located in the space between the first wall and the second wall.

13. The sound isolation system of claim 12, wherein a distance of the space between the first wall and the second wall is smaller than a wavelength at the resonant frequency:

$$D < \frac{c}{f},$$

and wherein D the distance of the space between the first wall and the second wall, c is a speed of sound, and f is the resonant frequency of the acoustic monopole response and the acoustic dipole response of the at least one acoustic scatterer.

14. The sound isolation system of claim 12, further comprising:

an array of acoustic scatterers located between the first wall and the second wall, wherein the array of acoustic scatterers includes a number (N) of acoustic scatterers, wherein the number (N) of acoustic scatterers is:

$N=D/(c/f)$, and wherein D is a distance between the first wall and the second wall, c is the speed of sound in air, and f is the resonant frequency of the monopole response and the dipole response.

15. The sound isolation system of claim 14, wherein the array of acoustic scatters are arranged along a row substantially perpendicular to one of the first wall and the second wall.

16. A sound isolation system comprising:

at least one acoustic scatterer for sound isolation, wherein the at least one acoustic scatterer comprises:

an acoustic monopole response and an acoustic dipole response, wherein the acoustic dipole response and the acoustic monopole response of the acoustic scatterer have substantially similar resonant frequencies, a first resonant chamber defined by a first housing, a first channel extending to the first resonant chamber defined by the first housing, a second resonant chamber defined by a second housing, and a second channel extending to the second resonant chamber defined by the second housing;

a first wall and a second wall, wherein the first wall and second wall generally oppose one another and define a space, wherein the at least one acoustic scatterer is located in the space between the first wall and the second wall; and the first housing is adjacent to the first wall and the second housing is adjacent to the second wall, wherein the first housing and second housing substantially face each other.

17. The sound isolation system of claim 16, wherein a distance between the first wall and the second wall is smaller than a wavelength at the resonant frequency:

$$D < \frac{c}{f},$$

and wherein D the distance of the space between the first wall and the second wall, c is a speed of sound, and f is the resonant frequency of the acoustic monopole response and the acoustic dipole response of the at least one acoustic scatterer.

* * * * *